US006283388B1

(12) United States Patent
Bolton

(10) Patent No.: US 6,283,388 B1
(45) Date of Patent: Sep. 4, 2001

(54) LIQUID DISPENSING APPARATUS

(76) Inventor: Terence William Bolton, 148 Portland Road, Hove, East Sussex, BN3 5QL (GB)

( * ) Notice: Subject to any disclaimer, the term of this patent is extended or adjusted under 35 U.S.C. 154(b) by 0 days.

(21) Appl. No.: 09/646,999

(22) PCT Filed: May 12, 1999

(86) PCT No.: PCT/GB99/01504

§ 371 Date: Sep. 22, 2000

§ 102(e) Date: Sep. 22, 2000

(87) PCT Pub. No.: WO99/59727

PCT Pub. Date: Nov. 25, 1999

(30) Foreign Application Priority Data

May 19, 1998 (GB) ..... 9810699

(51) Int. Cl.[7] ..... B05B 15/06; B05B 7/30; B05B 9/00

(52) U.S. Cl. ..... 239/532; 239/346; 239/326; 239/DIG. 14

(58) Field of Search ..... 239/532, 326, 239/145, 311, 294, 346, DIG. 14; 222/325, 630, 637, 78

(56) References Cited

U.S. PATENT DOCUMENTS 4,758,849 * 7/1988 Piatt et al. ..... 346/140 R
5,190,220 * 3/1993 Bolton ..... 239/305
5,248,096 * 9/1993 Hoey et al. ..... 239/272
5,421,518 * 6/1995 Robisch et al. ..... 239/311
5,454,517 * 10/1995 Naemura ..... 239/390
5,687,886 * 11/1997 Bolton ..... 222/630
6,024,300 * 2/2000 Bolton ..... 239/326

FOREIGN PATENT DOCUMENTS

WO-97/03757 * 11/1997 (WO) .

* cited by examiner

*Primary Examiner*—David A. Scherbel
*Assistant Examiner*—Davis Hwu
(74) *Attorney, Agent, or Firm*—Kinney & Lange, P.A.

(57) ABSTRACT

Liquid dispensing apparatus comprises a tubular casing having at one of its ends a mouthpiece and an elongate cap, and at the other of its ends a nozzle having an orifice in communication with an expansion chamber bounded by sides which diverge away from the orifice. A liquid source including an elongate body and an absorbent nib (e.g. a felt-tipped pen) is located within the casing with side surfaces of the pen body spaced from internal was surfaces of the casing to define an air flow passageway therebetween. First and second stop means are provided within the casing against the first of which a surface of the elongate body can abut to position the nib of the liquid source within or in close proximity to the nozzle orifice, and against the second of which a rearward end of the elongate body can abut to position the nib of the liquid source in a relatively airtight manner into one end of the elongate cap. The other end of the elongate cap is closed. Thus the liquid source can selectively be positioned with its nib within or in close proximity to the casing nozzle or with its nib effectively sealed within the elongate cap when the apparatus is not in use.

11 Claims, 2 Drawing Sheets

LIQUID DISPENSING APPARATUS

This invention relates to apparatus for dispensing a fine spray of liquid particles and more especially to liquid dispensing apparatus known as air brushes.

Conventional air brushes comprise a liquid store connected to receive high pressure gas from a source. The high pressure gas passes over the liquid store to produce a spray of liquid particles which is directed by a nozzle onto an appropriate surface. The pressurised gas from the source is supplied to the air brush via a conduit and its flow is controlled by a manually operated or automatically controlled valve. Typically the pressurised gas source includes propellant and is contained in a heavy metal cylinder. JP-A-61042350 and UK 2177620A disclose such an air brush in which the liquid store takes the form of a felt-tipped pen.

My British Patent 2245196 and International Patent Application PCT/GB93/02332 disclose air brush apparatus for dispensing fine sprays of liquid particles. These air brushes comprise a hand or foot operated pump connected to supply air under pressure directly to a nozzle so positioned that air leaving the nozzle is directed onto and over a nib of a felt-tipped pen releasably supported within a holder with the absorbent nib of the pen in close proximity to the nozzle outlet to cause liquid from the nib to be dispensed as a fine particulate spray in air.

An airbrush including a cylindrical housing formed with a mouthpiece for use with a felt-tipped pen is disclosed in published British Patent Application 2257058. The pen disclosed in this application is of special design and includes an end cap formed with a hole to equalise the pressure within the pen reservoir to avoid the presence of a vacuum.

An improved tubular construction of air brush dispenser is disclosed in International Patent Application PCT/GB94/00959, which corresponds to international publication number WO 94/26,421 and to U.S. Pat. No. 5,687,886. This dispenser comprises a hollow tubular housing and a felt-tipped pen which is retained within and spaced from the inner wall of the housing. The tubular housing includes at one end a nozzle and at its other end a mouth piece through which air can be caused to flow through the tubular housing and over the pen to the outlet orifice of the nozzle. An abutment is provided within the housing for locating the pen within the housing with its absorbent nib at least partially within the boundary of the outlet orifice of the nozzle.

PCT/EP96/01225, which corresponds to international publication number WO 97/03,757 and to U.S. Pat. No. 6,024,300, sets out to provide a simplified and relatively inexpensive dispenser which, as for my earlier Application PCT/GB94/00959, removes the need for a pump but which, by a blowing action, causes the required fine spray of coloured particles to be removed from a liquid store such as an absorbent nib of a pen containing a colourant, ink, paint or the like. The air brush dispenser of that invention is an improvement over my earlier design in that it provides a simple and very secure means for locating a pen or cartridge within the tubular casing and has an outlet nozzle whose profile optimises the flow of air around the nib of the pen or other liquid source thereby enabling even young children to operate the dispenser to achieve colouring effects normally associated with much more expensive and complicated equipment.

Dispensing apparatus according to PCT/EP96/01225 is described with reference to FIG. 1 of the accompanying drawings. As will be seen from FIG. 1, the apparatus comprises a tubular casing 1 formed in two separable parts

1A, 1B within which is housed a felt-tipped pen 2. Casing part 1A has a mouthpiece 3 which comprises an annular passageway 4 about a tubular cap 5 disposed at one end. The cap is spaced from the opposed internal wall surface of the casing part 1A by three fins 6. At its end remote from the mouthpiece 3, casing part 1A is flared to define a socket 7 into which can fit in a relatively tight manner one end 8 of casing part 1B. At its other end, casing part 1B has a nozzle 9 including an orifice 10 which opens into a converging expansion chamber 11. Three fins 12 protrude inwardly from the internal surfaces of the casing part 1B.

The body of the felt-tipped pen 2 has an absorbent nib 14. The absorbent nib defines the required source of liquid to be dispensed and the pen can be positioned within the casing 1 either with its nib 14 within the cap 5 of the mouthpiece 3 as shown in FIG. 2, or with its nib positioned within or in close proximity to the orifice 10 of the nozzle 9 as shown in FIG. 3. When in the former position, the nib 14 is intended to be effectively sealed within the cap 5 to prevent loss of fluid due to drying. When in the later position, the pen is supported centrally within the casing 1 by the fins 12 with a shoulder 15 of the pen body abutting against projecting stops 16 of the fins 12. In this position, the pen nib 14 extends into or is in close proximity to the orifice 10 of the nozzle 9.

In use, air is blown by the user through the mouthpiece 3 and the annular passageways defined between the opposed surfaces of the pen body 2 and the internal surfaces of the casing 1. The fins 12 ensure that the pen is centralised within the casing. As the blown air approaches the outlet nozzle 9 it passes over the nib 14 and then leaves the casing through the orifice 10 and the expansion chamber 11. As the air enters and passes through the expansion chamber it accelerates thereby inducing a swirling motion which ensures effective removal of liquid particles from the nib 14 of the pen 2. Siting the nib correctly with respect to orifice 10 of the nozzle 9 enables even young children to produce high quality air brush effects when using the apparatus.

With this design, it is intended that when the apparatus is not in use, it can be rearranged so that the pen or cartridge is removed from its outer casing, inverted and re-inserted into the casing with the nib of the pen or cartridge covered by the cap 5. The intention of so doing is to seal the nib effectively within the cap to prevent it drying out. However, it has been found that on many occasions this intention is not met. In transit for example, the pen has been found to move relative to the casing thereby at least partially exposing the nib to the air. Also, there have been occasions when the pen has been positioned too low within the casing after use, thereby not fully sealing the nib within the cap. Furthermore, it has been found that any slight movement or vibration of the apparatus can result in the pen or cartridge falling rearwardly into the casing 1B, therefore withdrawing the nib from the cap with the same adverse results.

It is an object of the present invention to provide a design which, when the apparatus is not in use, can be rearranged so that the nib of the pen or cartridge is fixed into position so that it is always sufficiently covered to prevent drying or other damage occurring.

According to the present invention in one aspect, there is provided liquid dispensing apparatus which comprises a tubular casing having at one of its ends a mouthpiece and an elongate cap, and at the other of its ends a nozzle having an orifice in communication with an expansion chamber bounded by sides which diverge away from the orifice, means for locating a liquid source including an elongate body and an absorbent nib within the casing with side surfaces of the elongate body spaced from internal wall surfaces of the casing to define an air flow passageway therebetween, first stop means within the casing against which a surface of the elongate body can abut to position the nib of the liquid source within or in close proximity to the nozzle orifice, and second stop means within the casing against which a rearward end of the elongate body can abut to position the nib of the liquid source in a relatively airtight manner into one end of the elongate cap, the other end of the elongate cap being closed, so that the liquid source can selectively be positioned with its nib within or in close proximity to the casing nozzle or with its nib effectively sealed within the elongate cap when the apparatus is not in use.

In one embodiment of the apparatus, the first and second stop means may be the same.

The locating means may comprise a plurality of fins extending inwardly from inner surfaces of the casing. One or each stop means may comprise steps formed in these fins.

The casing may be formed in two separable tubular parts, one such part terminating at one end in a socket into which one end of the other casing part can extend to define a relatively tight fit therewith. The liquid source may selectively be positioned with its nib within or in close proximity to the casing nozzle when in use. The first stop means within the casing allows the liquid source to extend into or be in close proximity to the orifice of the casing.

Alternatively, when the pen is not in use, the liquid source may be removed from the casing, inverted and re-inserted until the rearward end of the liquid source abuts against the second stop means within the casing. Thus, the liquid source is stably positioned with its nib effectively sealed within the elongate cap.

The liquid source may comprise a pen formed with a nib of absorbent material; such a liquid source is hereinafter referred to as a felt-tipped pen.

When the liquid source is positioned with its nib within or in close proximity to the casing nozzle, blowing through the mouthpiece causes air to flow into and through the expansion chamber to cause liquid particles to be removed from the surface of the absorbent nib of the pen and to produce a dispersion of these particles in air.

The casing interior may be formed over at least a major part of its length with three or more generally flat sides, the apices between neighbouring sides defining passageways for the flow of air when a pen or cartridge is positioned in the casing. In another construction, the casing interior is oval in cross-section.

In an alternative construction, the locating means comprises an inner tube in which the liquid source locates, the air flow passageway being defined between the outer periphery of this tube and the internal periphery of an outer tube spaced from the inner tube and substantially coaxial therewith.

Tie casing is preferably produced from a plastics material. Other materials may, however, be used.

The invention will now be described by way of example only with reference to the accompanying diagrammatic drawings in which:

FIGS. 1 to 3 illustrate an embodiment of a liquid dispensing apparatus in accordance with PCT/EP96/01225 and have already been discussed in detail hereinabove.

Figure 1:
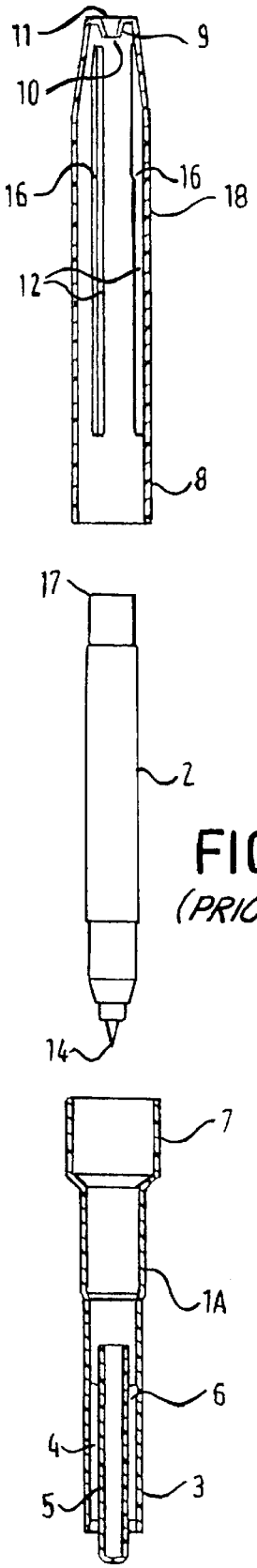
FIG.1. (PRIOR ART)
FIG. 1 is an exploded view partly in section of dispensing apparatus in accordance with PCT/EP96/01225.
Figure 2:
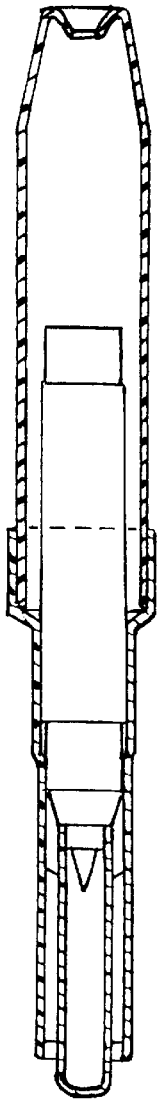
FIG.2. (PRIOR ART)
FIGS. 2 and 3 are side views in section of the assembled apparatus in its non-operational and operational modes respectively illustrated in FIG. 1.
Figure 3:
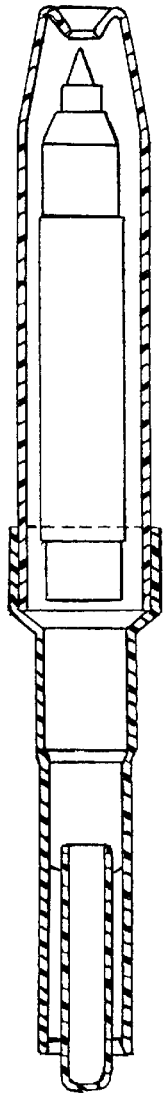
FIG.3. (PRIOR ART)
Figure 4:
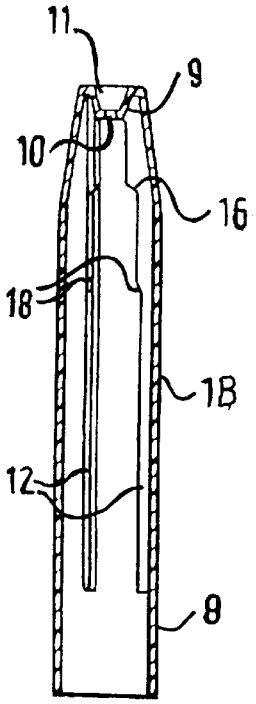
FIG. 4 is a side view in section of the elongate body of the pen or cartridge in accordance with the present invention.
Figure 5:
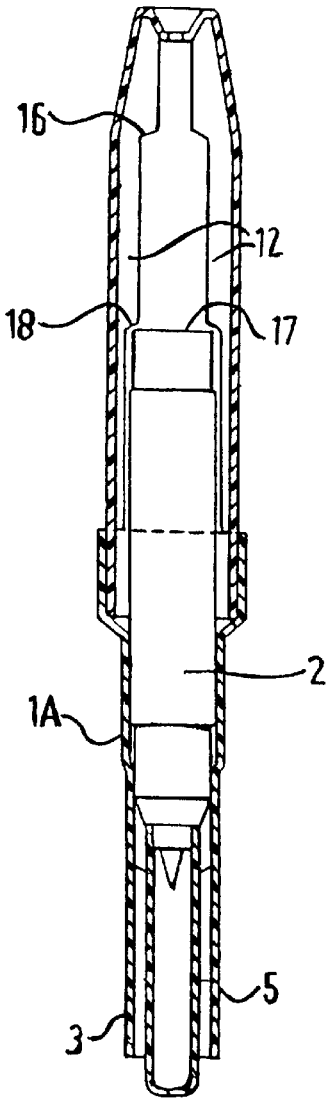
FIGS. 5 and 6 are side views in section of the assembled apparatus in accordance with one embodiment of the present invention in its non-operational and operational modes respectively.
Figure 6:
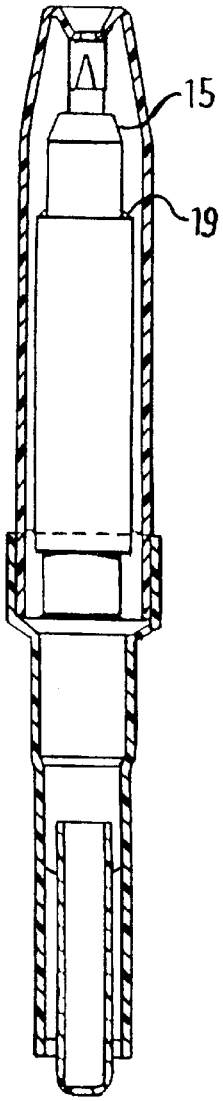

The apparatus of this invention includes the same basic components illustrated in FIGS. 1 to 3 with the addition of the modifications illustrated in FIGS. 4 to 6.

The casing part 1B of this invention is shown in FIG. 4. At its end remote from the nozzle 9, the casing can fit in a relatively tight manner into one end 7 of casing part 1A. At its other end, casing part 1B has a nozzle 9 including an orifice 10 which opens into a converging expansion chamber 11. Three fins 12 protrude inwardly from the internal surfaces of the casing part 1B. The fins include projecting stops at two positions. One set of projecting stops 16 are sited adjacent the orifice 10 of the casing; the other set of projecting stops 18 are sited downstream towards the casing end 8.

The pen can be positioned within the casing 1 either with its nib 14 within the cap 5 of the mouthpiece 3 as shown in FIG. 5 or with its nib positioned within or in close proximity to the orifice 10 of the nozzle 9 as shown in FIG. 6. When in the former position, the rearward end 17 of the body of the felt-tipped pen 2 abuts against projecting stops 18 of the fins 12 so that the nib 14 projects far enough into the casing 1A to be effectively sealed within the cap 5 to prevent loss of fluid due to drying. The stops 18 prevent any movement of the pen relative to the casing, thereby ensuring that the pen nib is always effectively sealed by the cap. When in the latter position, the pen is supported centrally within the casing 1 by the fins 12 with a shoulder 15 of the pen body abutting against projecting stops 16 of the fins 12 and optionally with a shoulder 19 of the pen body abutting against projecting stops 18 of the fins 12. In this position, the pen nib 14 extends into or is in close proximity to the orifice 10 of the nozzle 9.

In an alternative unillustrated embodiment, the casing is generally triangular in cross-section over a major part of its length with the three sides of the casing acting as locating surfaces to hold the pen in position. Thus, the need for fins 12 is removed. In this embodiment, projecting stops may take the form of steps on the internal surface of the casing. The spaces between the apices of the internal surfaces of the casing and the pen body define the required passageways for the flow of air from the mouthpiece to the nozzle. In other respects, the casing may be the same as that shown in FIGS. 4 to 6.

Other casing shapes having more than three flat sides may be adopted. Thus, the casing may be square or diamond-shaped in cross-section. Also, the casing may be oval in cross-section.

The casing, nozzle and mouthpiece may be produced from plastics; other suitable materials may however be employed.

In a further unillustrated embodiment, the casing includes an inner tube including projecting stops, within which the pen 2 is positioned relatively tightly for at least part of the length of the inner tube. In this arrangement, the inner tube is positioned within and spaced from the internal surface of the casing to define an air flow passage which places the mouthpiece in communication with the casing nozzle. The inner tube is preferably substantially coaxial with the casing.

For all of the various embodiments described above, a finely dispersed spray of coloured ink particles in air is achieved simply by blowing through the mouthpiece of the respective dispensing apparatus. The improved features of the dispensing apparatus in accordance with the invention enable the apparatus to be rearranged when not in use, and to remain stably rearranged regardless of external movement or vibration, so that the pen nib is always sufficiently covered to prevent drying or other damage occurring.

It will be appreciated that the apparatus described above is merely exemplary of dispensers in accordance with the invention and that modifications can readily be made thereto without departing from the true scope of the invention as set out in the appended claims.

What is claimed is:

1. Liquid dispensing apparatus which comprises a tubular casing having at one of its ends a mouthpiece and an elongate cap, and at the other of its ends a nozzel having an orifice in communication with an expansion chamber bounded by sides which diverge away from the orifice, means for locating a liquid source including an elongate body and an absorbent nib within the casing with side surfaces of the elongate body spaced from internal wall surfaces of the casing to define an air flow passageway therebetween, first stop means within the casing against which a surface of the elongate body can abut to position the nib of the liquid source within or in close proximity to the nozzle orifice, and second stop means within the casing against which a rearward end of the elongate body can abut to position the nib of the liquid source in a relatively airtight manner into one end of the elongate cap, the other end of the elongate cap being closed, so that the liquid source can selectively be positioned with its nib within or in close proximity to the casing nozzle or with its nib effectively sealed within the elongate cap when the apparatus is not in use.

2. Apparatus as claimed in claim 1 wherein the first and second stop means may be the same.

3. Apparatus as claimed in claim 1, wherein the locating means comprises a plurality of fins extending inwardly from inner surfaces of the casing.

4. Apparatus as claimed in claim 3 wherein one or each stop means comprises steps formed in these fins.

5. Apparatus as claimed in claim 1, wherein the casing is formed in two separable tubular parts, one such part terminating at one end in a socket into which one end of the other casing part can extend to define a relatively tight fit therewith.

6. Apparatus as claimed in claim 1, wherein the liquid source is positioned with its nib within or in close proximity to the casing nozzle when in use.

7. Apparatus as claimed in claim 1, wherein the first stop means within the casing is positioned to allow the liquid course to extend into or be in a close proximity to the orifice of the casing.

8. Apparatus as claimed in claim 1, wherein the liquid source comprises a pen formed with a nib of absorbent material.

9. Apparatus as claimed in claim 1, wherein the casing interior is formed over at least a major part of its length with three or more generally flat sides, the apices between neighbouring sides defining passageways for the flow of air when a pen or cartridge is positioned in the casing.

10. Apparatus as claimed in claim 1, wherein the casing interior is oval in cross-section.

11. Apparatus as claimed in claim 1, wherein the locating means comprises an inner tube in which the liquid source locates, the airflow passageway being defined between the outer periphery of this tube and the internal periphery of an outer tube spaced from the inner tube and substantially coaxial therewith.

* * * * *

UNITED STATES PATENT AND TRADEMARK OFFICE

CERTIFICATE OF CORRECTION

PATENT NO. : 6,283,388 B1
DATED : September 4, 2001
INVENTOR(S) : Terence W. Bolton It is certified that error appears in the above-identified patent and that said Letters Patent is hereby corrected as shown below:

Column 3,
Line 55, delete "Tie", insert -- The --

Column 5,
Line 16, delete "nozzel", insert -- nozzle --

Signed and Sealed this

Twenty-eighth Day of May, 2002

*Attest:*

*Attesting Officer*

JAMES E. ROGAN
*Director of the United States Patent and Trademark Office*